US010130219B2

(12) United States Patent
McDonald et al.

(10) Patent No.: US 10,130,219 B2
(45) Date of Patent: Nov. 20, 2018

(54) SHOWER STORAGE AND ASSIST ASSEMBLY

(71) Applicant: Kohler Co., Kohler, WI (US)

(72) Inventors: Alan T. McDonald, Sheboyan, WI (US); Sarah K. O'Brien, Sheboygan, WI (US); Yoon Kyum Koh, Daejeon (SO); Luke B. Zimbric, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 391 days.

(21) Appl. No.: 14/969,180

(22) Filed: Dec. 15, 2015

(65) Prior Publication Data

US 2016/0166118 A1 Jun. 16, 2016

Related U.S. Application Data

(60) Provisional application No. 62/092,393, filed on Dec. 16, 2014.

(51) Int. Cl.
*A47K 3/28* (2006.01)
*A47K 3/00* (2006.01)

(52) U.S. Cl.
CPC ..... *A47K 3/281* (2013.01); *A47K 3/003* (2013.01); *A47K 3/283* (2013.01)

(58) Field of Classification Search
CPC ..... A47K 2201/00; A47K 2201/02; A47K 17/022; A47K 17/024; A47K 3/003; A47K 3/281
USPC ..... 248/218.4, 219.1; 4/576.1, 571.1, 611, 4/548; 211/119.009, 119.011, 87.01
See application file for complete search history.

(56) References Cited

U.S. PATENT DOCUMENTS 626,739 A * 6/1899 Vanderman ..... A47K 1/09 211/119.009
1,050,974 A * 1/1913 Moore ..... F16M 11/24 211/87.01
1,432,206 A * 10/1922 Poole, Jr. ..... A47G 1/24 211/87.01
D65,730 S * 10/1924 Garreffa ..... 211/87.01
2,367,256 A * 1/1945 Atkins ..... E06C 7/14 248/210
4,541,535 A * 9/1985 Bartholomew ..... B68C 1/002 211/85.11

(Continued)

FOREIGN PATENT DOCUMENTS

CN 2631395 Y 8/2004
EP 1203852 A2 * 5/2002 ..... A47K 17/022

(Continued)

OTHER PUBLICATIONS

Canadian Office Action issued in corresponding application No. 2,915,196 dated Sep. 29, 2016.

*Primary Examiner* — Michael Safavi
(74) *Attorney, Agent, or Firm* — Foley & Lardner LLP

(57) ABSTRACT

A storage and assist assembly for a shower includes a first member, a second member, and an elongated member. The first member is configured to be coupled to an upper portion of a fixed wall member. The second member is configured to be coupled to a lower portion of the fixed wall member. The elongated member is removably coupled between the first and second members and is configured to receive one or more storage accessories thereon.

18 Claims, 4 Drawing Sheets

(56) References Cited

U.S. PATENT DOCUMENTS 4,991,723 A * 2/1991 Elkins ..... A47B 81/005 211/106.01
5,524,772 A * 6/1996 Simmons ..... A47B 81/005 211/4
5,678,702 A * 10/1997 Menaged ..... A47F 5/0823 211/59.1
5,803,273 A * 9/1998 Menaged ..... A47F 5/0807 211/105.1
5,855,279 A * 1/1999 Klein ..... A47B 61/04 211/113
6,196,398 B1 * 3/2001 Lowe ..... A47B 61/003 211/87.01
6,533,134 B1 * 3/2003 Menaged ..... A47F 5/0807 211/119.003
6,712,228 B2 * 3/2004 Lowe ..... A47B 49/00 211/119.004
6,902,071 B2 * 6/2005 Vitale ..... A47B 47/0016 211/35
6,922,857 B2 * 8/2005 Palma ..... A47K 3/12 4/573.1
7,967,522 B2 6/2011 Goad
8,533,912 B2 * 9/2013 Tran ..... A47B 95/02 16/110.1
2007/0034758 A1 * 2/2007 Bates ..... E04H 12/2276 248/218.4
2007/0251053 A1 * 11/2007 Miller ..... A47K 17/022 16/110.1
2012/0240327 A1 * 9/2012 Stimpson ..... A47K 3/003 4/605
2013/0193287 A1 * 8/2013 Murphy ..... A47G 7/045 248/219.1
2015/0096165 A1 * 4/2015 Hutchinson ..... E04B 1/185 29/525.01
2016/0183737 A1 * 6/2016 Yang ..... A47K 3/281 211/119.009

FOREIGN PATENT DOCUMENTS

EP 1428942 A2 * 6/2004 ..... A47K 3/281
FR 2616204 A1 12/1988
JP 2000192633 A * 7/2000 ..... A47K 17/022
JP 2007277846 A * 10/2007 ..... A47K 17/022

* cited by examiner

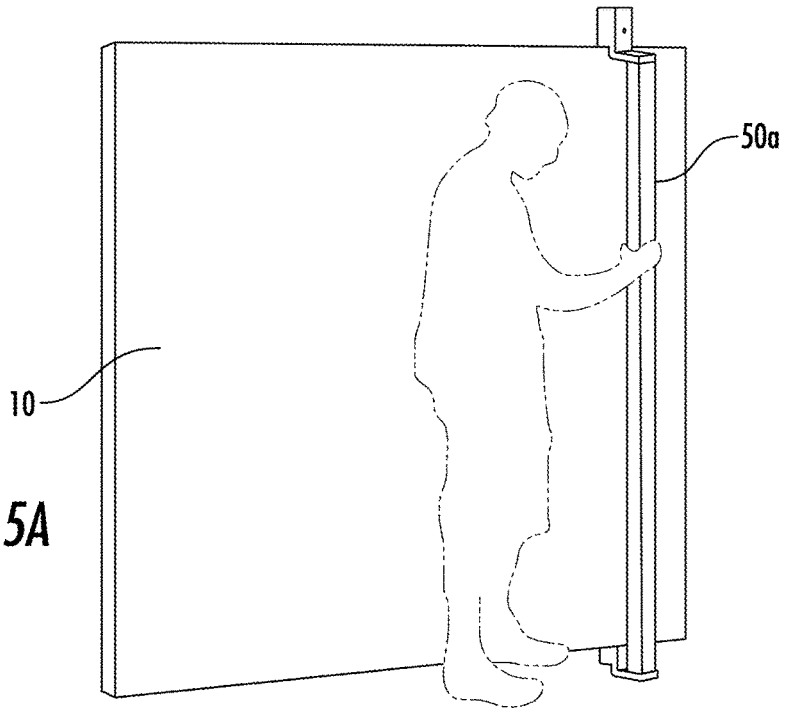
FIG. 5A
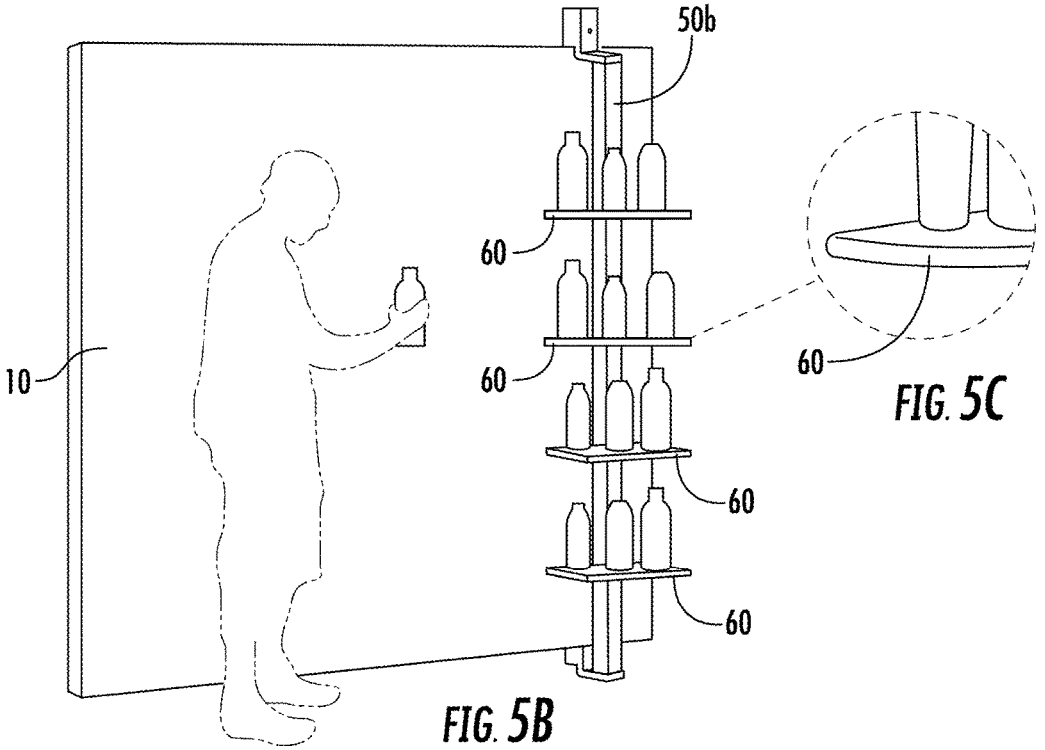
FIG. 5C
FIG. 5B

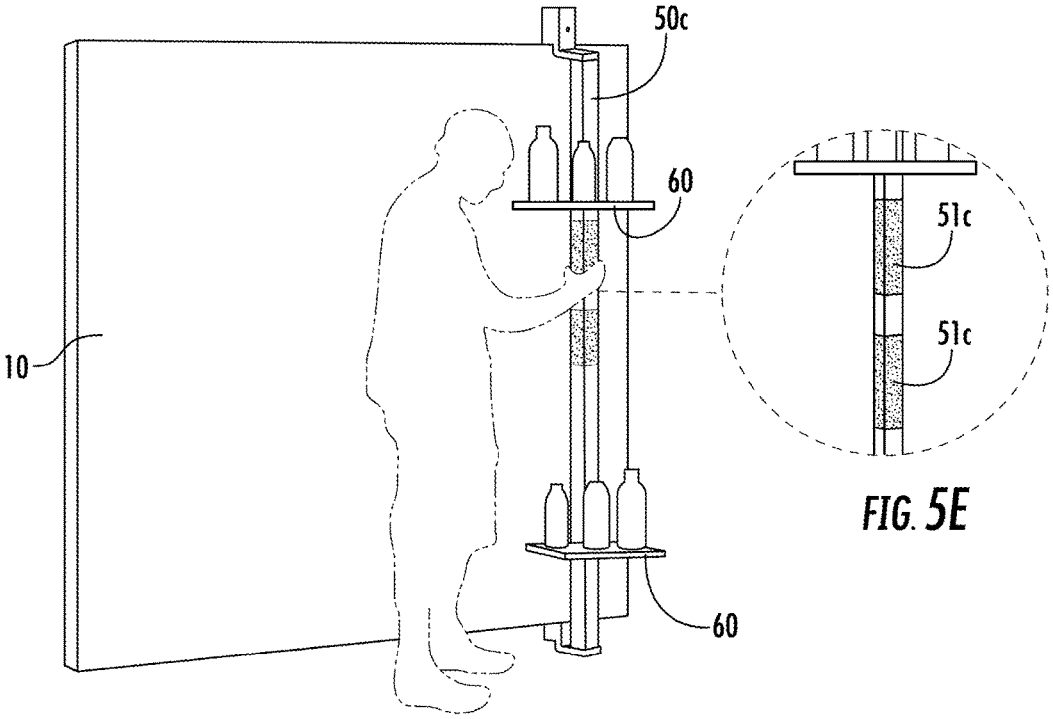
FIG. 5E
FIG. 5D
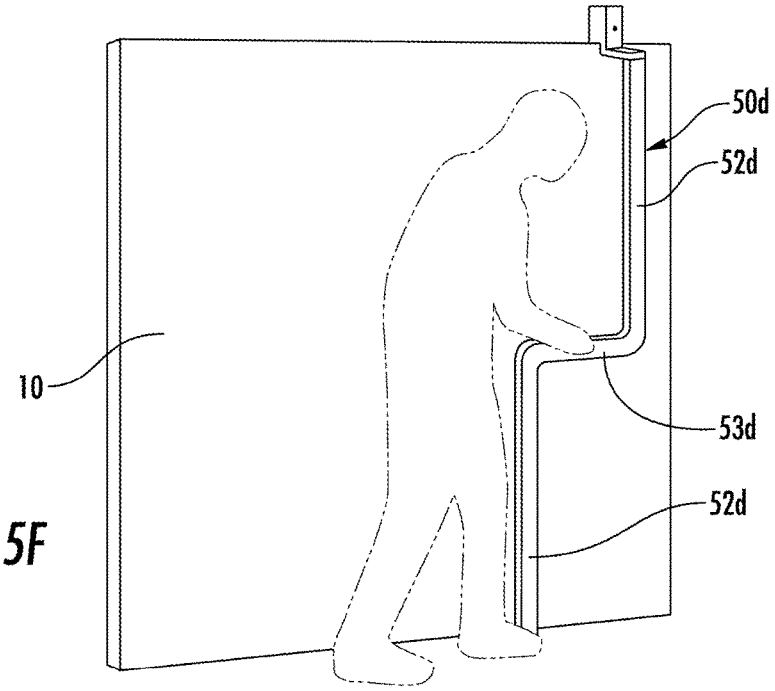
FIG. 5F

SHOWER STORAGE AND ASSIST ASSEMBLY

CROSS-REFERENCE TO RELATED PATENT APPLICATIONS

This application claims the benefit of and priority to U.S. Provisional Application No. 62/092,393, filed Dec. 16, 2014, the entire disclosure of which is incorporated by reference herein.

BACKGROUND

The present application relates generally to shower assemblies, and in particular, to shower storage and assist assemblies.

Generally speaking, a shower or bathing environment, such as a shower enclosure or the like, can include an assist assembly sometimes referred to as a "grab bar" or other device to assist a user with entering or exiting the shower or bathing area. Typically, the grab bar is mounted through, for example, openings in the walls of the shower enclosure or bathing area. Most grab bars are complicated to install, and are not adaptable or reconfigurable once installed. In addition, many grab bars have limited functionality in that they only provide a fixed member for grabbing by a user to assist with entering or exiting the shower area, and do not provide any additional functionality.

Accordingly, it would be advantageous to provide an assist assembly that is easy to install within a shower or bathing environment, is reconfigurable or adaptable to provide flexibility to a user or an installer, and can provide additional functionality outside of assisting users with entering or exiting a shower or bath. These and other advantageous features will become apparent to those reviewing the present disclosure.

SUMMARY

One embodiment relates to a storage and assist assembly for a shower including a first member, a second member, and an elongated member. The first member is configured to be coupled to an upper portion of a fixed wall member. The second member is configured to be coupled to a lower portion of the fixed wall member. The elongated member is removably coupled between the first and second members and is configured to receive one or more storage accessories thereon.

Another embodiment relates to a storage and assist assembly for a shower including a first member, a second member, and an elongated member. The first member is configured to be coupled to an upper portion of a fixed wall member. The second member is configured to be coupled to a lower portion of the fixed wall member. The elongated member is removably coupled between the first and second members and is configured to support at least a portion or all of a human's weight. The elongated member includes a first vertical portion, a horizontal portion extending from an end of the first vertical portion, and a second vertical portion extending from an end of the horizontal portion opposite to and offset from the first vertical portion.

Yet another embodiment relates to a storage and assist assembly for a shower including a first member, a second member, and an elongated member. The first and second members each include a front wall, a pair of side walls, a flange, and a protrusion. The first member is configured to be coupled to an upper portion of a fixed wall member. The second member is configured to be coupled to a lower portion of the fixed wall member. The elongated member is removably coupled between the first and second members and is configured to support at least a portion or all of a human's weight and to receive one or more storage accessories thereon. The pair of side walls each extend outwardly from the front wall to define a sleeve configured to receive the upper portion or the lower portion of the fixed wall member therein. The flange extends outwardly from the front wall opposite the pair of side walls. The protrusion extends from a top surface or a bottom surface of the flange for being received within and coupled to the elongated member.

BRIEF DESCRIPTION OF THE DRAWINGS

FIG. 5A is a perspective view of a vertical assist assembly installed in a shower enclosure according to an exemplary embodiment.

FIG. 5B is a perspective view of a vertical storage assembly installed in a shower enclosure according to an exemplary embodiment.

FIG. 5C is a detail view of the vertical storage assembly of FIG. 5B.

FIG. 5D is a perspective view of a vertical assist and storage assembly installed in a shower enclosure according to an exemplary embodiment.

FIG. 5E is a detail view of the vertical assist and storage assembly of FIG. 5D.

FIG. 5F is a perspective view of a vertical and horizontal assist assembly installed in a shower enclosure according to an exemplary embodiment.

DETAILED DESCRIPTION

Referring generally to the figures, disclosed herein are storage and assist assemblies for a shower or bathing area that are adaptable/reconfigurable and are easy to install within, for example, a shower enclosure without substantial modifications to the enclosure area. The storage and assist assemblies can, advantageously, provide assistance to a user entering or exiting the shower enclosure and can provide a variety of storage solutions for various bathing accessories.

Figure 1:
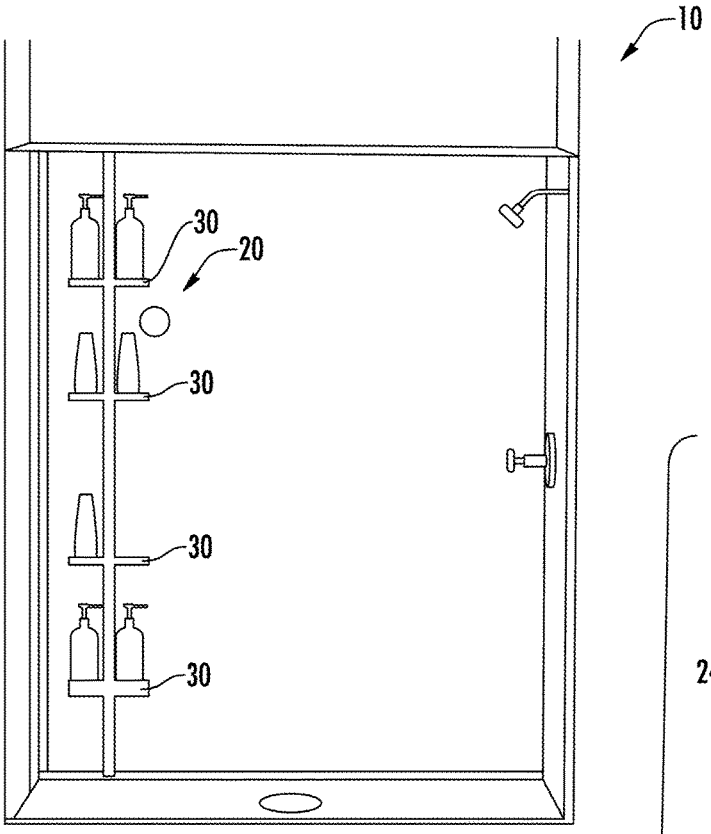
FIG. 1 is a perspective view of a storage assembly installed in a shower enclosure, according to an exemplary embodiment.

According to an exemplary embodiment shown in FIG. 1, a storage assembly 20 is coupled within a bathing area shown as a shower enclosure 10. In the embodiment of FIG. 1, the storage assembly 20 is a storage assembly configured to hold one or more storage accessories 30, such as shelves, bins, dispensers, holders, or other similar types of accessories. The storage accessories 30 are configured to hold a variety of different bathing items, such as, for example, soap dispensers, shampoo bottles, razors, washcloths, toys, or other items that can be used in a bathing environment. According to other exemplary embodiments shown in FIGS.

4-5D and discussed in greater detail below, the assembly 20 is configured as an assist assembly (e.g., a grab bar, a support bar, handle, etc.) configured to assist a user with using the shower enclosure 10, such as to enter or exit the shower enclosure 10.

Although the bathing area is shown as a shower enclosure in FIG. 1 for use in a wide variety of residential and/or commercial applications, it is appreciated that the assembly 20 can be installed in a variety of different indoor/outdoor showers, bathing areas, or recreational areas, such as in or near swimming pools, hot tubs, and the like, according to other exemplary embodiments. In the embodiment shown in FIG. 1, the shower enclosure 10 is coupled to a fixed structure such as a wall of a building, a ceiling, a joist, or another fixed portion/structure of a building. According to an exemplary embodiment, the assembly 20 is coupled to a fixed portion of the building through openings of the shower enclosure 10 and/or above a wall member of the shower enclosure 10 (see, for example, FIG. 4). In other exemplary embodiments, the assembly 20 is coupled directly to the shower enclosure 10, such as to a wall panel of the enclosure. In various exemplary embodiments, the assembly 20 can be installed in shower enclosures having different wall configurations such as, for example, tile down and flat wall configurations, among other configurations.

Figure 2:
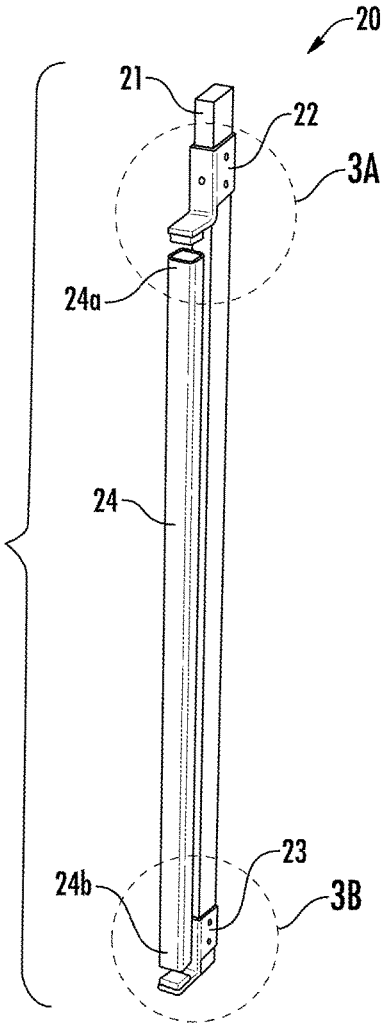
FIG. 2 is a perspective view of a storage assembly coupled to a wall joist, according to an exemplary embodiment.

Referring now to FIG. 2, the assembly 20 is shown coupled to a portion of a wall frame shown as a wall joist 21, according to an exemplary embodiment. In this embodiment, the assembly 20 includes an upper member 22 (e.g., a first member, etc.) coupled to an upper portion of the wall joist 21. The assembly 20 also includes a lower member 23 (e.g., a second member, etc.) coupled to a lower portion of the wall joist 21. Each of the upper member 22 and the lower member 23 include a flanged portion configured to receive an elongated member 24. The elongated member 24 includes a first end 24*a* and a second end 24*b*. The elongated member 24 can be coupled to the upper member 22 at the first end 24*a* and to the lower member 23 at the second end 24*b*. According to an exemplary embodiment, the elongated member 24 is configured to support one or more accessories thereon, such as storage accessories 30 shown in FIG. 1 (e.g., shelves, bins, etc.). The elongated member 24 can be further configured to support at least a portion or all of the weight of a user (e.g., a human being, a child, etc.), so as to provide support or assistance to a user of the bathing area, according to an exemplary embodiment.

As shown in FIG. 2, the elongated member 24 has a generally hollow, rectangular cross-sectional shape, although the elongated member 24 may have a different cross-sectional shape, such as circular, octagonal, or other cross-sectional shapes, according to other exemplary embodiments. According to an exemplary embodiment, the elongated member 24 is at least partially hollow, such as at the ends of the elongated member 24 to facilitate removably coupling the elongated member 24 to a shower enclosure. The elongated member 24 can be made from any rigid or semi-rigid materials, or combinations of materials, such as aluminum, steel, plastic, composite, or any other rigid or semi-rigid material or combinations of materials suitable for the particular application of the assembly 20. According to an exemplary embodiment, the elongated member 24 includes a grip portion (shown in FIG. 5E) configured to allow a user to easily and comfortably grip the elongated member 24 with their hands when using the shower enclosure 10. The grip portion can be, for example, a rubberized or other textured or frictional coating disposed on and extending along at least a portion or all of the elongated member 24. In other exemplary embodiments, the grip portion is a rubber sleeve disposed over at least a portion or all of the elongated member 24.

Figure 3A:
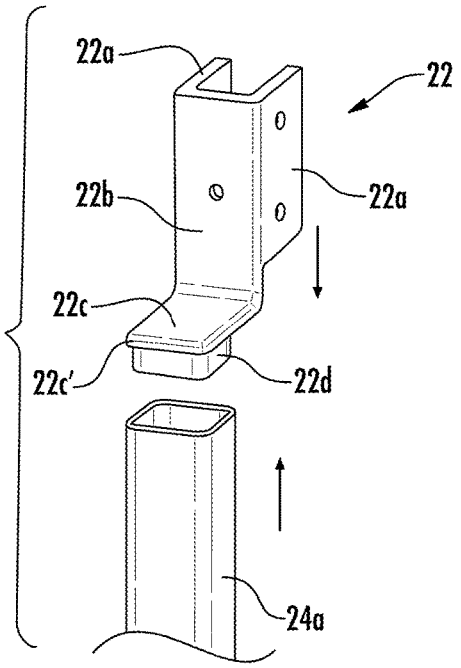
FIG. 3A is a partial perspective view of an upper portion of the storage assembly of FIG. 2.

Referring now to FIG. 3A, an upper portion of the assembly 20 including the upper member 22 and the first end 24*a* of the elongated member 24 is shown, according to the exemplary embodiment of FIG. 2. The upper member 22 includes a pair of side walls 22*a* and a front wall 22*b* configured to couple to, for example, the wall joist 21 shown in FIG. 2. The side walls 22*a* and the front wall 22*b* are generally planar and include one or more apertures for coupling the upper member 22 to a fixed structure or wall of a building or a shower enclosure. The side walls 22*a* and the front wall 22*b* are arranged to define an opening or sleeve for receiving, for example, an upper portion of the wall joist 21.

As shown in FIG. 3A, the front wall 22*b* includes a flange 22*c* extending outwardly from a lower portion of the front wall 22*b*, opposite the side walls 22*a*. The flange 22*c* is oriented perpendicular to the front wall 22*b*. The flange 22*c* includes a protrusion 22*d* disposed on a lower surface of the flange 22*c*. The protrusion 22*d* is surrounded by the flange 22*c*, so as to define a rim 22*c*' extending along an outer periphery of the flange 22*c*. The protrusion 22*d* is configured to be inserted into an opening of the elongated member 24 at the first end 24*a* (represented by arrows in FIG. 3A) to couple the elongated member 24 to the upper member 22. The rim 22*c*' is configured to engage an end surface of the first end 24*a* and to be flush mounted relative to the first end 24*a* to provide a cohesive appearance. That is to say, an outer side peripheral surface of the flange 22*c* is substantially coplanar with an outer side surface of the first end 24*a* of the elongated member 24 to provide a unitary appearance.

According to an exemplary embodiment, the protrusion 22*d* has an outer surface profile that is complementary to an inner surface profile of the first end 24*a* of the elongated member 24, such that the protrusion 22*d* can be inserted into and received within the first end 24*a*. According to an exemplary embodiment, the protrusion 22*d* has an interference fit with the first end 24*a* of the elongated member 24, such that the elongated member 24 is coupled relative to the upper member 22. In this manner, the elongated member 24 can be removably coupled to the upper member 22 without the need for any fasteners (e.g., glue, bolts, screws, etc.).

Figure 3B:
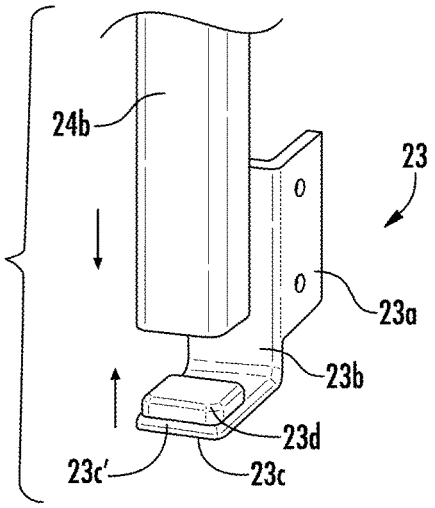
FIG. 3B is a partial perspective view of a lower portion of the storage assembly of FIG. 2.

Similarly, as shown in FIG. 3B, the lower member 23 includes a pair of side walls 23*a* and a front wall 23*b*. The side walls 23*a* and the front wall 23*b* are generally planar and include one or more apertures for coupling the lower member 22 to a fixed structure of a building or a shower enclosure. The side walls 23*a* and the front wall 23*b* are arranged to define an opening or sleeve for receiving, for example, a lower portion of the wall joist 21.

As shown in FIG. 3B, the front wall 23*b* includes a flange 23*c* extending outwardly from a lower portion of the front wall 23*b*, opposite the side walls 23*a*. The flange 22*c* is oriented perpendicularly to the front wall 22*b*. The flange 23*c* includes a protrusion 23*d* disposed on an upper surface of the flange 23*c*. The protrusion 23*d* is surrounded by the flange 23*c*, so as to define a rim 23*c*' extending along a periphery of the flange 23*c*. The protrusion 23*d* is configured to be inserted into an opening of the elongated member 24 at the second end 24*b* (represented by arrows in FIG. 3B) to couple the elongated member 24 to the lower member 22. The rim 23*c*' is configured to engage an end surface of the second end 24*b* and to be flush mounted relative to the second end 24*b* to provide a cohesive appearance. That is to say, an outer side peripheral surface of the flange 23*c* is substantially coplanar with an outer side surface of the second end 24*b* of the elongated member 24.

According to an exemplary embodiment, the protrusion 23*d* has an outer surface profile that is complementary to an inner surface profile of the second end 24*b* of the elongated member 24, such that the protrusion 23*d* can be inserted into and received within the second end 24*b*. According to an exemplary embodiment, the protrusion 23*d* has an interference fit with the second end 24*b* of the elongated member 24, such that the elongated member 24 is coupled relative to the lower member 22. In this way, the elongated member 24 can be removably coupled in a wide variety of adaptable configurations relative to the shower enclosure 10.

According to an exemplary embodiment, the elongated member 24 may be removed from each of the upper member 22 and the lower member 23 by, for example, loosening one or both of the upper member 22 or the lower member 23 from the wall joist 21, and pulling the elongated member 24 in an axial direction to disengage the elongated member 24 from either the flange 22*c* or the flange 23*c*. In this manner, a user can easily disassemble the assembly 20 for maintenance and/or repair. In addition, a user or an installer may replace the elongated member 24 with an elongated member having a different configuration, such as a vertical storage bar 50*a* (see FIG. 5B), a vertical assist and storage bar 50*c* (see FIG. 5D), or a vertical and horizontal assist bar 50*d* (see FIG. 5F), according to other exemplary embodiments. In this way, the assembly 20 is adaptable to allow a user or an installer to change the configuration of the shower or bathing environment to meet a user's needs.

According to various exemplary embodiments, the upper member 22 and the lower member 23 are each made from a semi-rigid material, such as a plastic or a composite material, which may include antibacterial and/or antimicrobial additives or properties, and that resist staining, wear and corrosion. The upper member 22 and the lower member 23 may be coupled to a fixed structure (e.g., wall joist 21, etc.) using one or more fasteners such as screws, nails, or any other fastener suitable for the particular application of the assembly 20.

Figure 4:
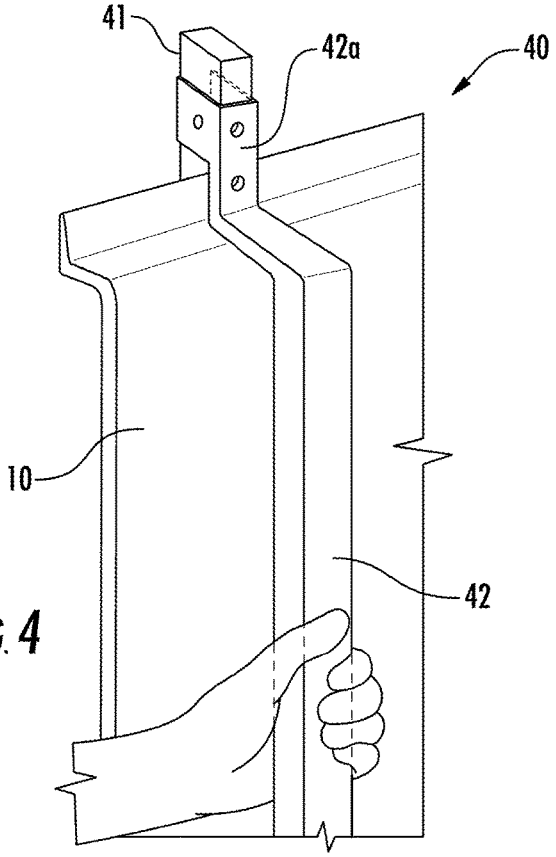
FIG. 4 is a perspective view of an assist assembly installed in a shower enclosure, according to an exemplary embodiment.

Referring now to FIG. 4, an assembly 40 is shown as an assist bar, according to an exemplary embodiment. The assembly 40 is similar to the assembly 20 of FIGS. 1-3B, however, the assembly 40 includes an elongated member 42 having an integrated upper member 42*a* and an integrated lower member 42*b* (not shown) for coupling the assembly 40 to a fixed structure, such as a wall joist 41. The integrated upper member 42*a* and lower member 42*b* have a similar structure and function as the upper member 22 and the lower member 23 of FIGS. 3A-3B, respectively. As shown in FIG. 4, the assembly 40 is arranged adjacent to a portion of the shower enclosure 10 to enable a user to grab the elongated member 42 to assist the user with using (e.g., entering, exiting, moving around, etc.) the shower enclosure. Assembly 40 is configured to support at least a portion of the weight of a user, so as to provide support or assistance to a user of the bathing area where the assembly 40 is installed.

Referring now to FIGS. 5A-5F, various storage and assist assemblies are shown, according to various exemplary embodiments. The various storage and assist assemblies shown in FIGS. 5A-5F include an elongated member (e.g., 50*a*, 50*b*, 50*c*, and 50*d*) that can be removably coupled to the upper member 21 and the lower member 22 of FIGS. 2-3B to allow a user or an installer to change the configuration of the assembly depending on a user's needs. For example, according to an exemplary embodiment shown in FIG. 5A, an assembly 50*a* is shown as a vertical assist bar coupled relative to a shower enclosure wall 10. The assembly 50*a* is configured to provide support or assistance to a user when using the shower enclosure wall 10, such as when moving relative to the shower enclosure wall 10. That is to say, the assembly 50*a* can support at least a portion or all of a user's weight to assist the user with, for example, entering or exiting a shower enclosure.

According to another exemplary embodiment shown in FIGS. 5B-5C, an assembly 50*b* is shown as a vertical storage bar configured to hold one or more accessories shown as shelves 60. According to other exemplary embodiments, the accessories can be storage bins, compartments, or any other accessory suitable to provide a storage area on the assembly 50*b*. The shelves 60 are removably coupled to the assembly 50*b* to allow for maintenance and/or for a user or an installer to create different storage configurations. The assembly 50*b* is coupled relative to the shower enclosure 10 to provide access for convenient storage of various bathing items on the shelves 60 (e.g., shampoo bottles, soap, etc.).

According to another exemplary embodiment shown in FIGS. 5D-5E, an assembly 50*c* is shown as a dual storage and assist bar. In this embodiment, the assembly 50*c* includes a grip portion 51*c* disposed along two portions of the assembly 50*c* to allow a user to easily and comfortably grab the assembly 50*c* to, for example, assist the user with moving relative to the shower enclosure wall 10. According to other exemplary embodiments, the grip portion 50*c* extends along only one portion or along the entire length of the assembly 50*c*. The assembly 50*c* further includes one or more accessories shown as shelves 60 removably coupled to the assembly 50*c*. In this manner, the assembly 50*c* provides storage capabilities and assistance to a user of the shower enclosure. In the exemplary embodiments of FIGS. 5B-5E, the accessories are shown as shelves 60, but may be another type of storage accessory such as a storage bin, a storage bracket, or any other accessory suitable to provide storage capabilities in the assembly, according to other exemplary embodiments.

According to another exemplary embodiment shown in FIG. 5F, an assembly 50*d* is shown as a horizontal and vertical assist bar coupled to the shower enclosure wall 10. In this embodiment, the assembly 50*d* includes both a vertical support section 52*d* and a horizontal support section 53*d* to provide for greater flexibility and assistance to a user of, for example, a shower enclosure. The horizontal support section 53*d* is located near a middle portion of the assembly 50*d* at a height suitable for a user to grab the section for support. In the various exemplary embodiments described above in FIGS. 5A-5F, the assemblies 50*a*-50*d* can have a similar construction as the exemplary embodiments of FIGS. 1-4, including similar materials and mounting arrangements.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A storage and assist assembly for a shower, comprising:
a first member configured to be coupled to an upper portion of a fixed wall member;
a second member configured to be coupled to a lower portion of the fixed wall member; and
an elongated member removably coupled between the first and second members and configured to receive one or more storage accessories thereon;
wherein the first and second members each comprise:
a front wall;
a pair of side walls extending outwardly from the front wall to define a sleeve configured to receive a portion of the fixed wall member therein;
a flange extending outwardly from the front wall opposite the pair of side walls; and
a protrusion extending from at least one of a top surface or a bottom surface of the flange.

2. The assembly of claim 1, wherein the elongated member is further configured to support at least a portion or all of a human's weight.

3. A storage and assist assembly for a shower, comprising:
a first member configured to be coupled to an upper portion of a fixed wall member;
a second member configured to be coupled to a lower portion of the fixed wall member; and
an elongated member removably coupled between the first and second members and configured to receive one or more storage accessories thereon;
wherein the first and second members each comprise:
a front wall;
a pair of side walls extending outwardly from the front wall to define a sleeve configured to receive a portion of the fixed wall member therein;
a flange extending outwardly from the front wall opposite the pair of side walls; and
a protrusion extending from at least one of a top surface or a bottom surface of the flange;
wherein the flange is generally planar and is oriented perpendicular to the front wall.

4. A storage and assist assembly for a shower, comprising:
a first member configured to be coupled to an upper portion of a fixed wall member;
a second member configured to be coupled to a lower portion of the fixed wall member; and
an elongated member removably coupled between the first and second members and configured to receive one or more storage accessories thereon, wherein the elongated member has a first end and a second end opposite the first end, and wherein the elongated member is substantially hollow to define an interior cavity;
wherein the first and second members each comprise:
a front wall;
a pair of side walls extending outwardly from the front wall to define a sleeve configured to receive a portion of the fixed wall member therein;
a flange extending outwardly from the front wall opposite the pair of side walls; and
a protrusion extending from at least one of a top surface or a bottom surface of the flange.

5. A storage and assist assembly for a shower, comprising:
a first member configured to be coupled to an upper portion of a fixed wall member;
a second member configured to be coupled to a lower portion of the fixed wall member; and
an elongated member removably coupled between the first and second members and configured to receive one or more storage accessories thereon, wherein the elongated member has a first end and a second end opposite the first end, and wherein the elongated member is substantially hollow to define an interior cavity;
wherein the first and second members each comprise:
a front wall;
a pair of side walls extending outwardly from the front wall to define a sleeve configured to receive a portion of the fixed wall member therein;
a flange extending outwardly from the front wall opposite the pair of side walls; and
a protrusion extending from at least one of a top surface or a bottom surface of the flange;
wherein the elongated member is configured to receive the protrusions of the first and second members within the first and second ends, respectively.

6. A storage and assist assembly for a shower, comprising:
a first member configured to be coupled to an upper portion of a fixed wall member;
a second member configured to be coupled to a lower portion of the fixed wall member; and an elongated member removably coupled between the first and second members and configured to receive one or more storage accessories thereon, wherein the elongated member has a first end and a second end opposite the first end, and wherein the elongated member is substantially hollow to define an interior cavity;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the elongated member is configured to receive the protrusions of the first and second members within the first and second ends, respectively; and wherein the elongated member is removably coupled to the first and second members via an interference fit with the protrusions.

7. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to receive one or more storage accessories thereon, wherein the elongated member has a first end and a second end opposite the first end, and wherein the elongated member is substantially hollow to define an interior cavity;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the elongated member is configured to receive the protrusions of the first and second members within the first and second ends, respectively;

wherein the elongated member is removably coupled to the first and second members via an interference fit with the protrusions; and wherein the protrusions each have an outer surface profile that is complementary to an inner surface profile of the first and second ends of the elongated member.

8. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to receive one or more storage accessories thereon, wherein the elongated member has a first end and a second end opposite the first end, and wherein the elongated member is substantially hollow to define an interior cavity;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the elongated member is configured to receive the protrusions of the first and second members within the first and second ends, respectively;

wherein the flange surrounds the protrusion to define a rim extending along an outer periphery of the flange for engaging an end surface of the first or second ends of the elongated member, and wherein an outer surface of the flange is substantially flush with an outer surface of the elongated member at the first and second ends, respectively.

9. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to support at least a portion or all of a human's weight;

wherein the elongated member includes a first vertical portion, a horizontal portion extending from an end of the first vertical portion, and a second vertical portion extending from an end of the horizontal portion opposite to and offset from the first vertical portion;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange.

10. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to support at least a portion or all of a human's weight;

wherein the elongated member includes a first vertical portion, a horizontal portion extending from an end of the first vertical portion, and a second vertical portion extending from an end of the horizontal portion opposite to and offset from the first vertical portion;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the flange is generally planar and is oriented perpendicular to the front wall.

11. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to support at least a portion or all of a human's weight;

wherein the elongated member includes a first vertical portion, a horizontal portion extending from an end of the first vertical portion, and a second vertical portion extending from an end of the horizontal portion opposite to and offset from the first vertical portion;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the elongated member has a first end and a second end opposite the first end, and wherein the elongated member is substantially hollow to define an interior cavity.

12. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to support at least a portion or all of a human's weight;

wherein the elongated member includes a first vertical portion, a horizontal portion extending from an end of the first vertical portion, and a second vertical portion extending from an end of the horizontal portion opposite to and offset from the first vertical portion;

wherein the first and second members each comprise:

a front wall;

a pair of side walls extending outwardly from the front wall to define a sleeve configured to receive a portion of the fixed wall member therein;

a flange extending outwardly from the front wall opposite the pair of side walls; and a protrusion extending from at least one of a top surface or a bottom surface of the flange;

wherein the elongated member has a first end and a second end opposite the first end, and wherein the elongated member is substantially hollow to define an interior cavity;

wherein the elongated member is configured to receive the protrusions of the first and second members within the first and second ends, respectively.

13. The assembly of claim 12, wherein the elongated member is removably coupled to the first and second members via an interference fit with the protrusions.

14. The assembly of claim 13, wherein the protrusions each have an outer surface profile that is complementary to an inner surface profile of the first and second ends of the elongated member.

15. The assembly of claim 12, wherein the flange surrounds the protrusion to define a rim extending along an outer periphery of the flange for engaging an end surface of the first or second ends of the elongated member, and wherein an outer side surface of the flange of each of the first and second members is substantially coplanar with an outer side surface of the elongated member at the first and second ends, respectively.

16. A storage and assist assembly for a shower, comprising:

a first member configured to be coupled to an upper portion of a fixed wall member;

a second member configured to be coupled to a lower portion of the fixed wall member; and an elongated member removably coupled between the first and second members and configured to support at least a portion or all of a human's weight and to receive one or more storage accessories thereon;

wherein the first and second members each comprise:

a front wall;

a pair of side walls extending outwardly from the front wall to define a sleeve configured to receive the upper portion or the lower portion of the fixed wall member therein;

a flange extending outwardly from the front wall opposite the pair of side walls; and a protrusion extending from at least one of a top surface or a bottom surface of the flange for being received within and coupled to the elongated member.

17. The assembly of claim 16, wherein the elongated member has a first end and a second end opposite the first end, and wherein the elongated member is substantially hollow to define an interior cavity at the first and seconds ends to receive the protrusions of the first and second members therein, respectively.

18. The assembly of claim 17, wherein the elongated member is removably coupled to the first and second members via an interference fit with the protrusions at the first and second ends, respectively.

* * * * *